US005094542A

United States Patent [19]

Engels et al.

[11] Patent Number: 5,094,542

[45] Date of Patent: Mar. 10, 1992

[54] MODULAR MIXER SYSTEM

[75] Inventors: David J. Engels, Springwater; William F. Hutchings, Fairport; David Mechler, Fairport, all of N.Y.

[73] Assignee: General Signal Corporation, Stamford, Conn.

[21] Appl. No.: 615,531

[22] Filed: Nov. 19, 1990

[51] Int. Cl.[5] ..... B01F 7/00

[52] U.S. Cl. ..... 366/282; 366/284; 366/349

[58] Field of Search ..... 366/129, 349, 601, 281, 366/282, 283, 284

[56] References Cited

U.S. PATENT DOCUMENTS

| | | | |
|---|---|---|---|
| 1,703,099 | 2/1929 | Craddock | 366/282 |
| 2,209,287 | 7/1940 | Simpson | 366/281 X |
| 2,311,586 | 2/1943 | Tyler | 366/281 X |
| 2,787,449 | 4/1957 | McElroy | 366/282 X |
| 2,841,723 | 7/1958 | Corbett | 366/601 X |
| 2,911,240 | 11/1959 | Boutros et al. | 366/282 X |
| 3,533,600 | 10/1970 | Gerson | 366/129 |
| 3,533,715 | 10/1970 | Gross | 366/129 X |
| 3,572,650 | 3/1971 | Kupka | 366/284 |
| 3,916,729 | 11/1975 | Herr . | |
| 3,924,978 | 12/1975 | Lloyd, Jr. . | |
| 3,937,096 | 2/1976 | Lundin . | |
| 4,046,030 | 9/1977 | Oh . | |
| 4,198,373 | 4/1980 | Kropp et al. | 366/282 X |
| 4,306,865 | 12/1981 | Leonard . | |
| 4,330,045 | 5/1982 | Myers . | |
| 4,349,758 | 9/1982 | Grant . | |
| 4,383,768 | 5/1983 | Kupka | 366/349 X |
| 4,413,611 | 4/1983 | Berlik . | |
| 4,452,102 | 6/1984 | Shaffer . | |
| 4,456,425 | 6/1984 | McCarty . | |
| 4,554,989 | 11/1985 | Gruich . | |
| 4,575,255 | 3/1986 | Kafka | 366/129 |
| 4,645,352 | 2/1987 | Valbona et al. | 366/129 X |
| 4,653,928 | 3/1987 | Bravo | 366/601 |
| 4,693,685 | 9/1987 | Pernot . | |
| 4,735,639 | 4/1988 | Johnstone . | |
| 4,753,534 | 6/1988 | Markle | 366/349 X |
| 4,777,393 | 10/1988 | Peat . | |
| 4,780,047 | 10/1988 | Holt . | |

FOREIGN PATENT DOCUMENTS

| | | | |
|---|---|---|---|
| 2928787 | 5/1980 | Fed. Rep. of Germany | 366/349 |

OTHER PUBLICATIONS

Lightnin (®) Bulletin on "Portable, Fixed Mount and Inclined Mixers", Copyright 1989, Mixing Equipment Co., Rochester, NY.

"Lightnin (®) Quik-Connect (TM) Modular Mixers", 1986.

*Primary Examiner*—Frankie L. Stinson

*Attorney, Agent, or Firm*—Martin Lukacher

[57] ABSTRACT

A modular mixer system which enables motor, transmission, bearing housing and impeller shaft components to be selected and combined as required for particular mixing applications. The components may be assembled to provide either direct drive from the motor to the impeller shaft contained in the bearing housing (without reduciton gears), or through a gear transmission (with an interplate and intershaft where seal removal is required), and form a mixer drive subassembly. This subassembly is mounted on mounts which provide portability; these mounts having pivotal clamps for mounting the mixer system on the wall of a tank or the like. Various fixed mounts may also be used, which are in the form of plates or pedestals which rigidly connect the mixer system to a tank or beam above the tank. In all cases the bearing housing is common and forms the core to which the components of the drive assembly and the mount are connected. The bearing housing and the transmission may be of different sizes, but are otherwise interchangeable with other components of like size.

In a mixer system adapted to be mounted on a closed tank, a seal unit in the mount (a pedestal, for example) is removable without requiring removal of the motor and gear transmission from the mount by use of an interplate which closes off the gear transmission at the bottom thereof. An intershaft in the interplate transmits power to the impeller shaft which is contained in a bearing housing which is connected to the interplate and is detachable therefrom and removable from the mount. When removed, the shaft and seal are exposed for seal (or stuffing) replacement while the motor and gear transmission remain in place thereby making seal replacement much more rapid and less expensive than when the motor and gears must be removed to get to the seals.

21 Claims, 14 Drawing Sheets

MODULAR MIXER SYSTEM

The present invention relates to mixer systems for mixing and stirring liquids and liquid suspensions, especially for commercial and industrial applications, and particularly to a modular mixer system having interchangeable components which can be assembled into systems with or without geared transmissions, and having different structures for mounting the mixer system adjacent to the vessel where mixing operations are carried out.

Mixing applications vary widely and require mixer systems of different power and impeller rotation speed and other characteristics. Support required for the mixer system also varies, depending upon the nature of the tank (open tank or closed) and the need to remove the mixer from the tank so that it becomes free for use on other tanks or allows the tank to undergo other processes than mixing. Seals are required in some applications, particularly closed tank applications, and require facilities for seal change. It is desired to be able to change seals rapidly and inexpensively; i.e., without disassembly of the entire mixer.

Existing mixer systems are not modular in design. For example, totally different mixers have been used where the impeller shaft is directly driven and where a gear-drive unit is necessary to meet the power, speed, and other requirements. Modularity in the true sense means that entire assemblies of the mixing system are interchangeable. These assemblies are the prime mover (an electrical, air, hydraulic or other type of motor), a shaft support system containing bearings for support of the shaft directly or through a stub or quill shaft (which receives therein the impeller shaft), a coupling between the impeller shaft and the bearing support system for attaching it to the bearing support, an impeller or impellers on the impeller shaft, and a mount for the mixer system. Many mixer systems have directly driven impeller shafts. Other mixer systems use transmissions (usually gearing) between the motor and the bearing support structure. Still other requirements are facilities for seals and stuffing boxes and for connecting or mounting the mixer on or adjacent to a tank or vessel where mixing is carried out. Heretofore, there was no commonality perceived among the various components, which may or may not be needed, in a system for a particular application in order to achieve modularity. Mixer bodies for direct drive units were totally different from those having gear drives. In other words, housings and bearings were different to provide allowances for the gear structure.

Modularity has been sought after, but so far, only achieved on a part level; for example, a domestic food mixer with "modular" internal framework, motor, and speed control parts has been proposed (see Grant, U.S. Pat. No. 4,349,758 issued Sept. 14, 1982). The mixing equipment industry has not, heretofore, provided a mixer system which did not use completely differently designed sections between the impeller shaft and the motor of the mixer; notwithstanding that modularity engenders efficiency in manufacturing, and also, importantly, provides the necessary flexibility to afford a mixing system which meets the application presented by a particular customer.

It has been discovered, in accordance with the invention, that by utilizing a shaft bearing system which enables the shaft to be driven either by a gear drive or directly from the motor, the commonality which supports modular design can be obtained. The bearing system is supported in a housing which enables connection of selectable motors and of gear boxes, when desired, to provide a unitary mixer drive and then provides connection to a mounting structure necessary to meet the customer's application (portable or fixed mounts for closed or open tanks). In addition, interplates having seals and which facilitate the changing of a seal unit of the mixer (seal assemblies or stuffing boxes) may readily be incorporated as units of the modular assembly. The interplate is arranged in accordance with the invention to support the motor and gear drive thereby allowing the bearing housing to be removed so that the seals can be changed without having to disassemble the motor and gear drive.

Briefly described, a mixer system embodying the invention is capable of driving at least one impeller on an impeller shaft. The system is adapted to be assembled from a plurality of modular components which are selected in accordance with the motor drive power, power transmission and mounting characteristics which characterize the selected mixer system. The mixer system has a bearing housing for rotatably supporting the mixer shaft. The mixer shaft extends from the lower end of the bearing housing. The bearing housing has an upper end, suitably with a flange. The upper end has means for interchangeably assembling those of the modular components providing drive power to the impeller shaft (different motors) which are then mounted directly upon the upper end of the bearing housing for direct drive of the mixer shaft. The upper end of the bearing housing also can receive a transmission thereon. The transmission also has means for interchangeably assembling different motors at the upper end thereof. The system also is provided with a mounting component which attaches to the bearing housing, preferably to the flange thereof and preferably independently of attachment means (bolts) which are used to assemble the drive subassembly (motor, transmission and bearing support structure) of the mixer system.

The foregoing and other objects, features and advantages of the invention will become more apparent from a reading of the following description in connection with the accompanying drawings in which.

Figure 3:
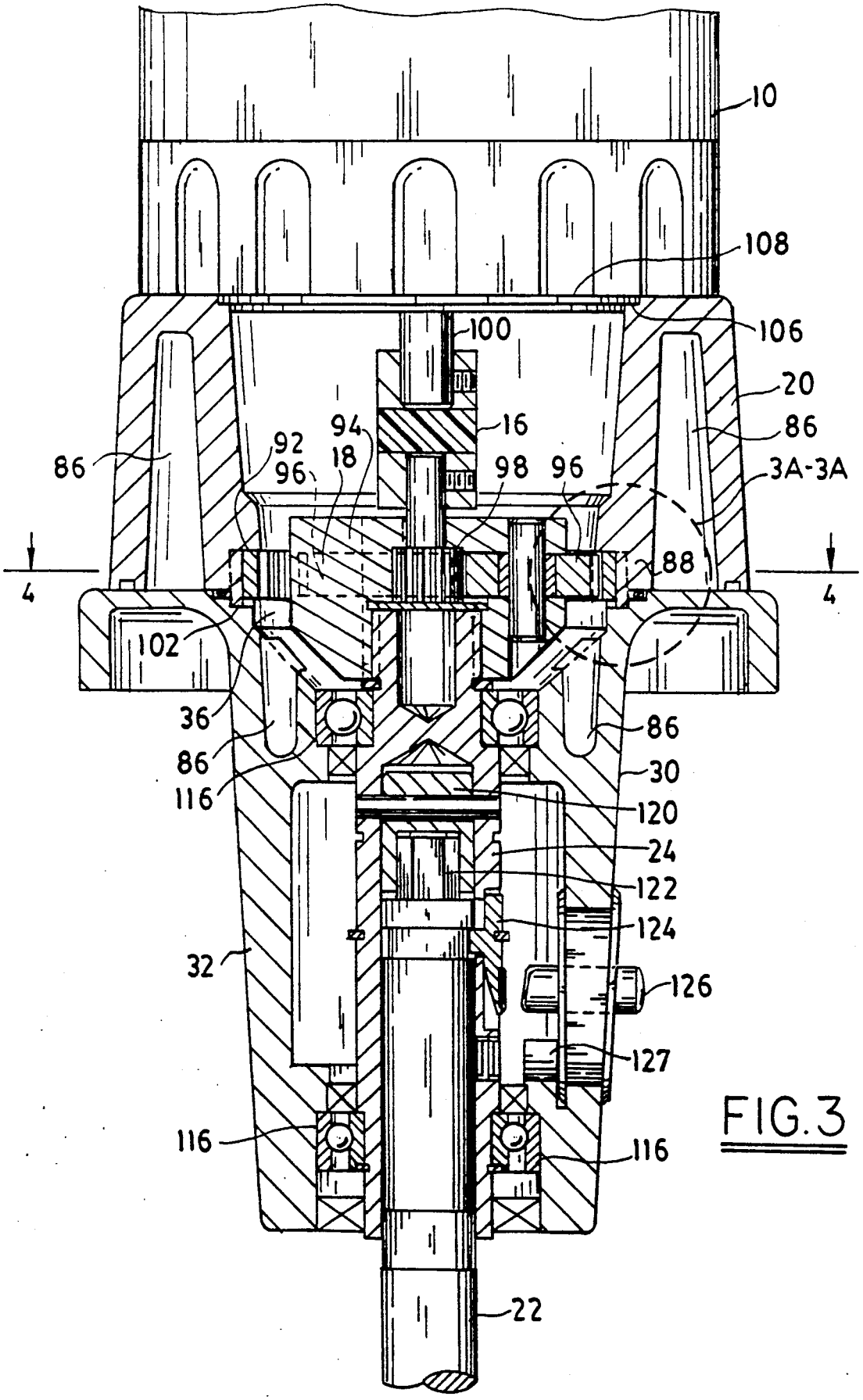
FIG. 3 is a sectional view showing the gear drive subassembly of the mixer system shown in FIG. 2.
Figure 3A:
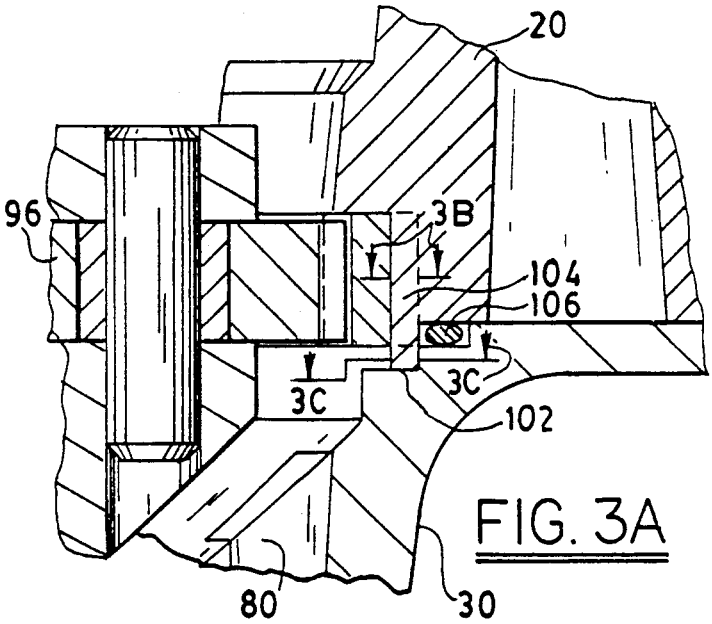
Figure 3B:
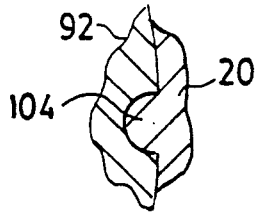
Figure 3C:
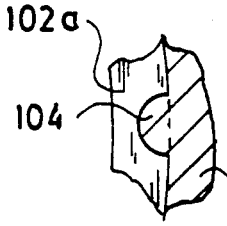

FIGS. 3A, B and C are respectfully sectional views along the line 3*a*—3*a*, 3*b*—3*b* and 3*c*—3*c* which illustrate the means for interchangeably interconnecting either the motor or the gear box transmission to the top of the flange of the bearing housing shown in FIG. 3.

Figure 1:
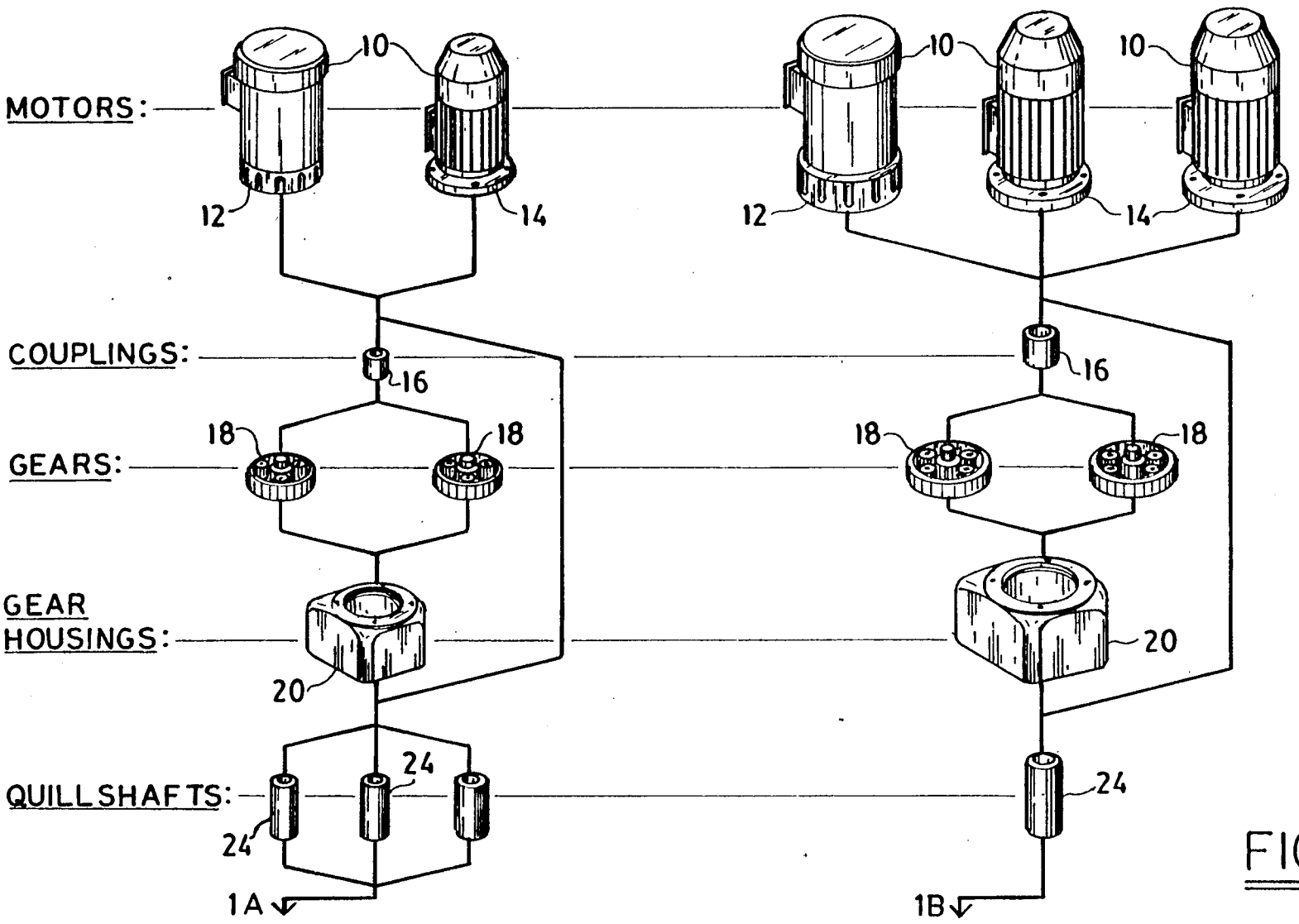
FIG. 1 is an exploded view showing different modular components and parts of mixer systems provided in accordance with the invention.
Figure 1:
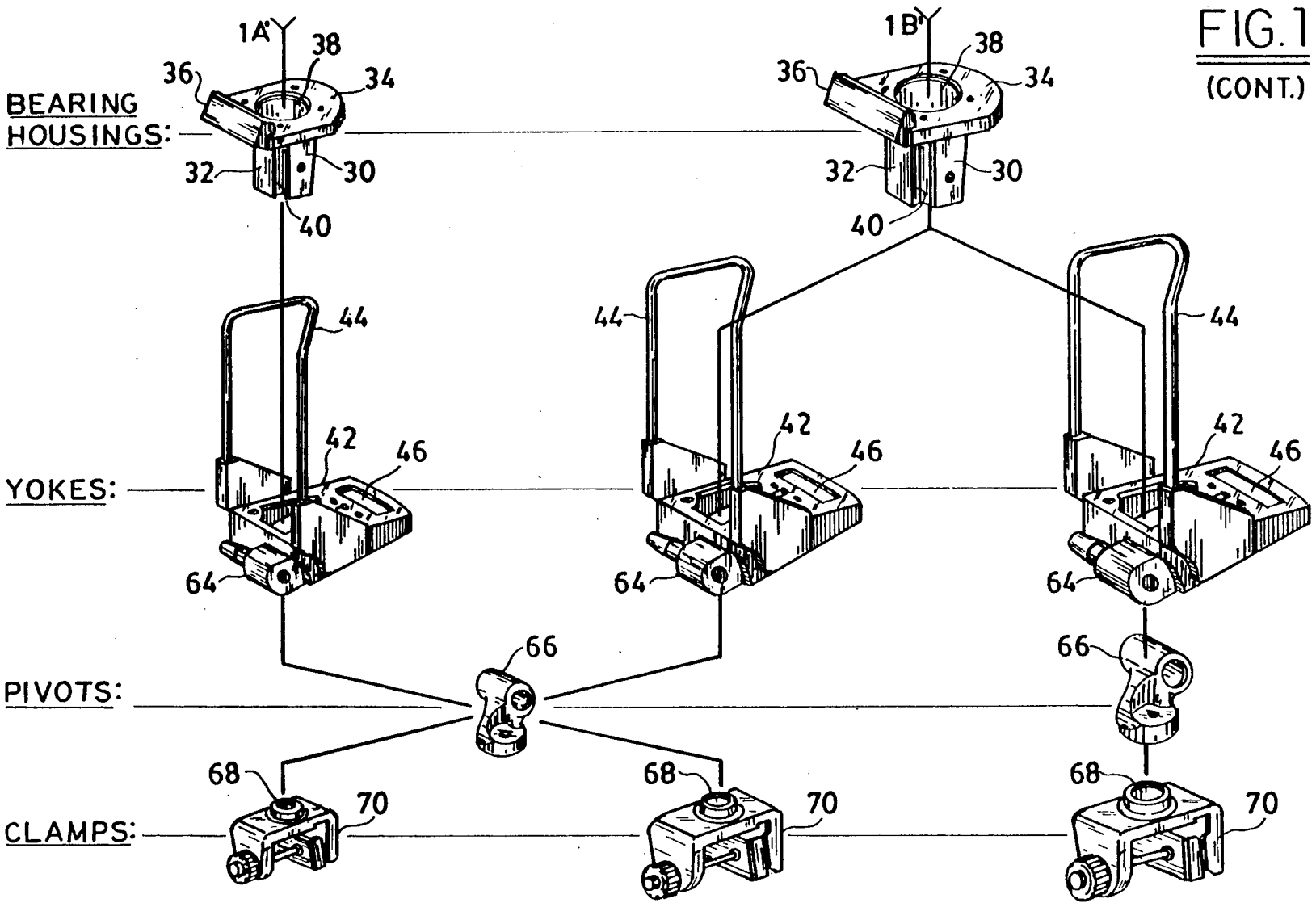
Figure 2:
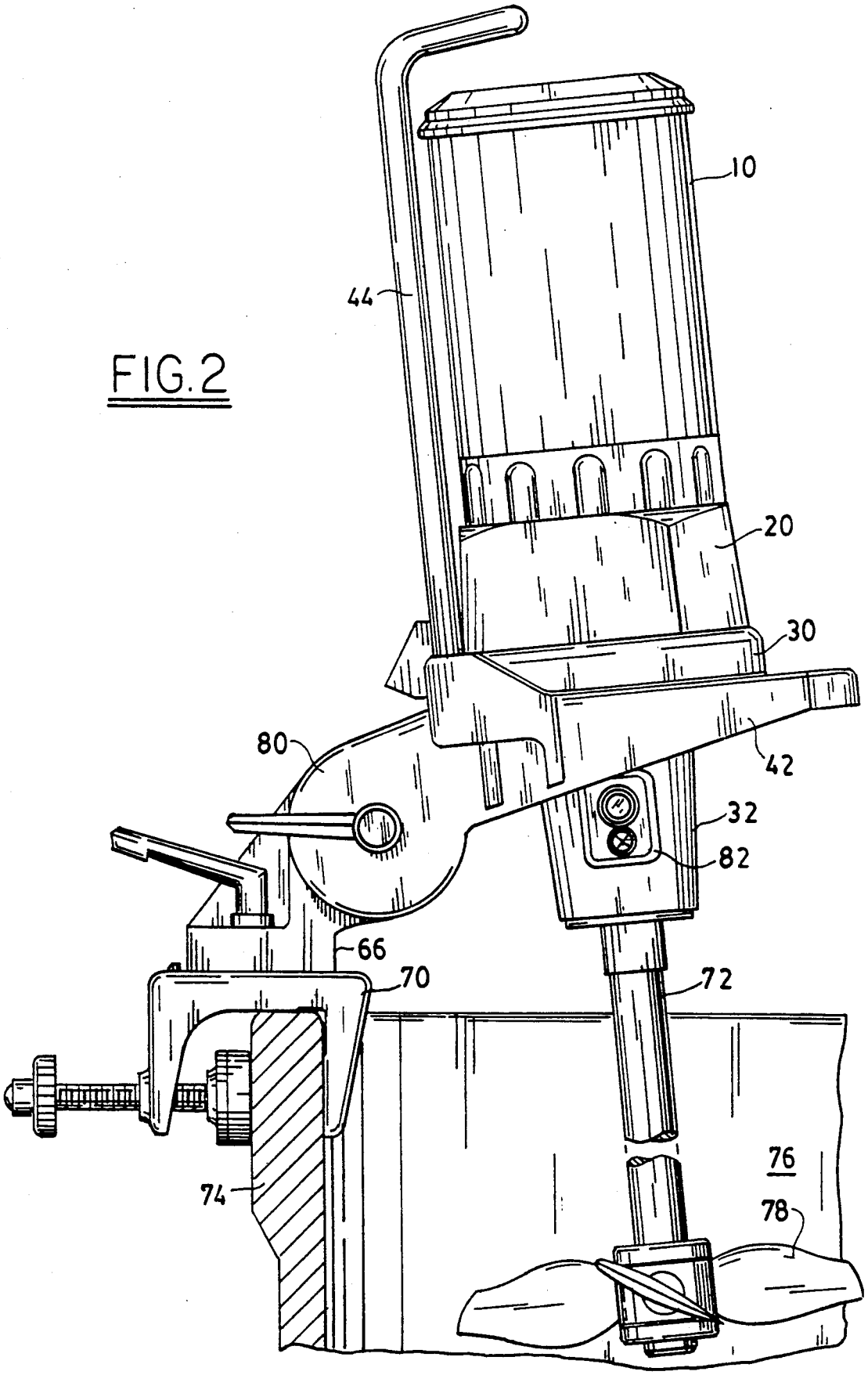
FIG. 2 is a side view fragmentarily showing a portion of the tank in which mixing is carried out, of a mixing system assembled from components shown in FIG. 1.
Figure 3D:
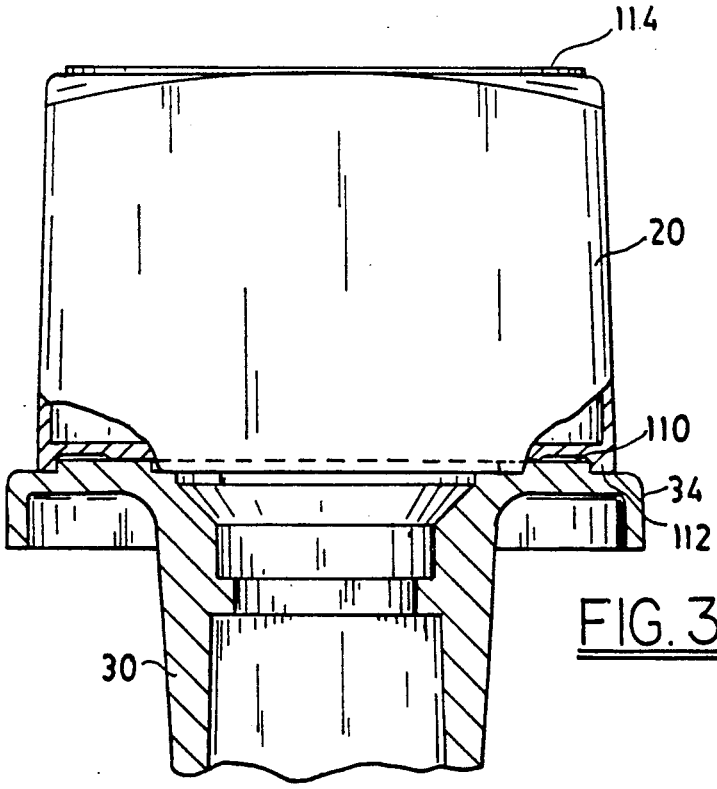
Figure 4:
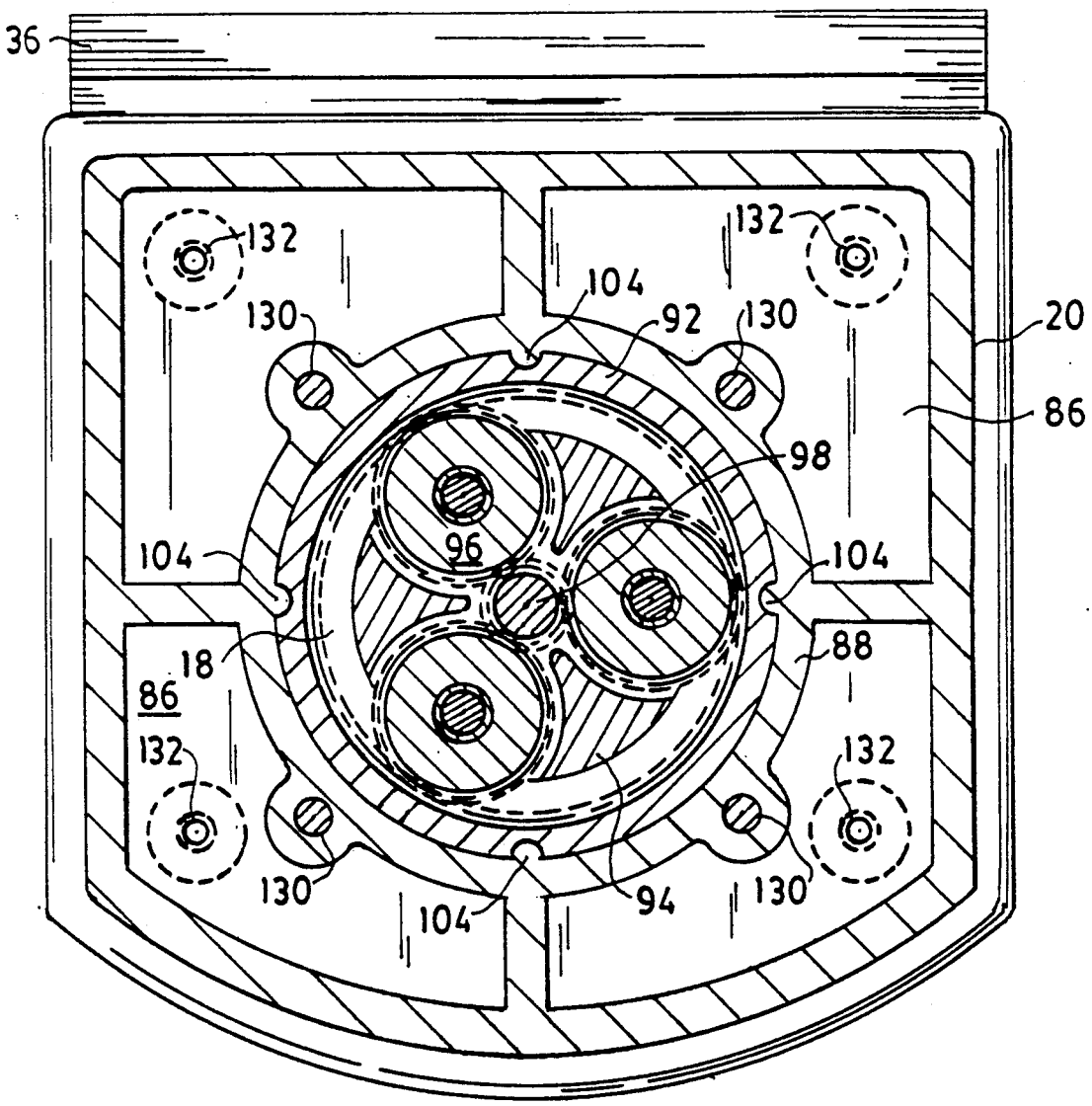
Figure 5:
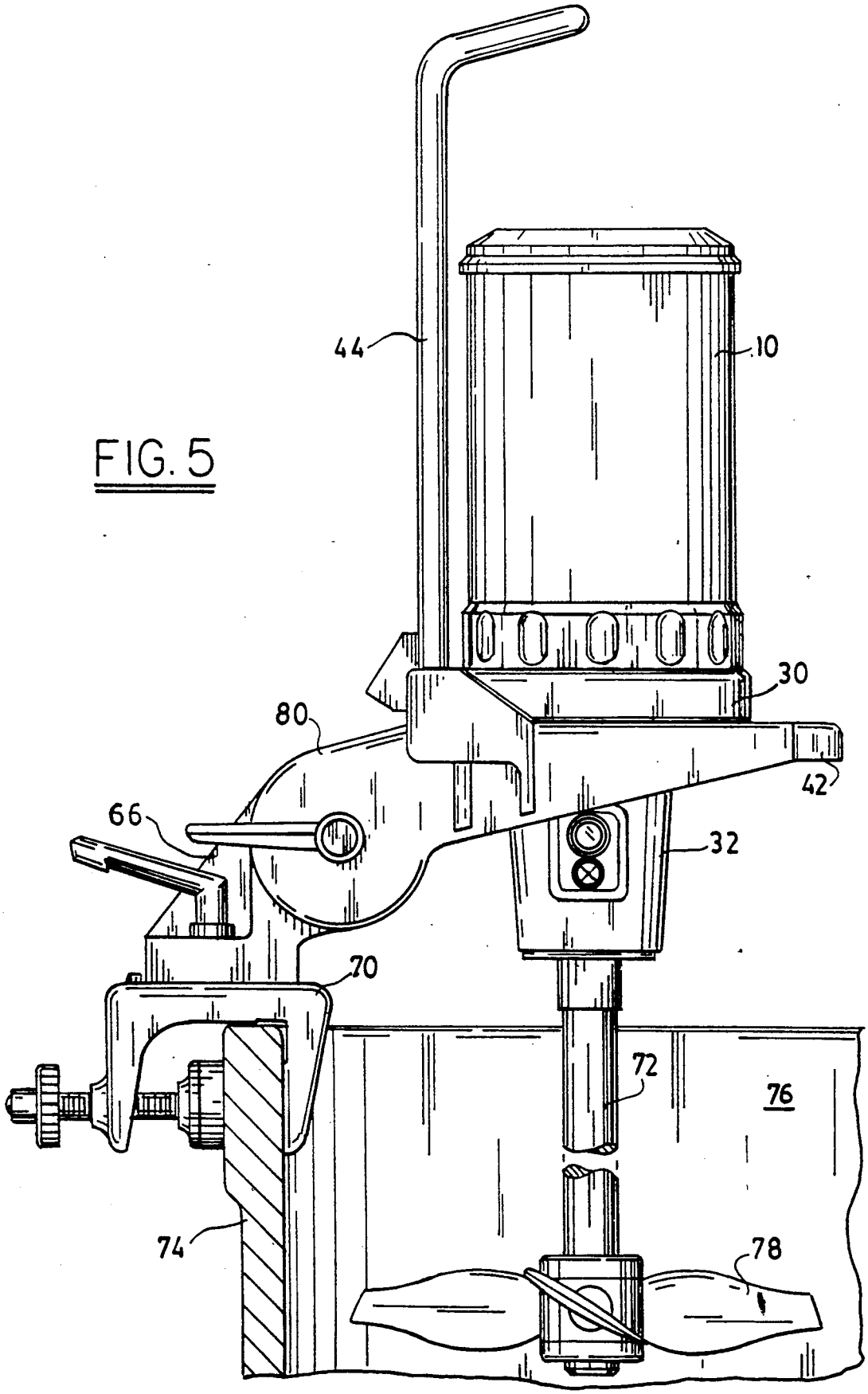
Figure 6:
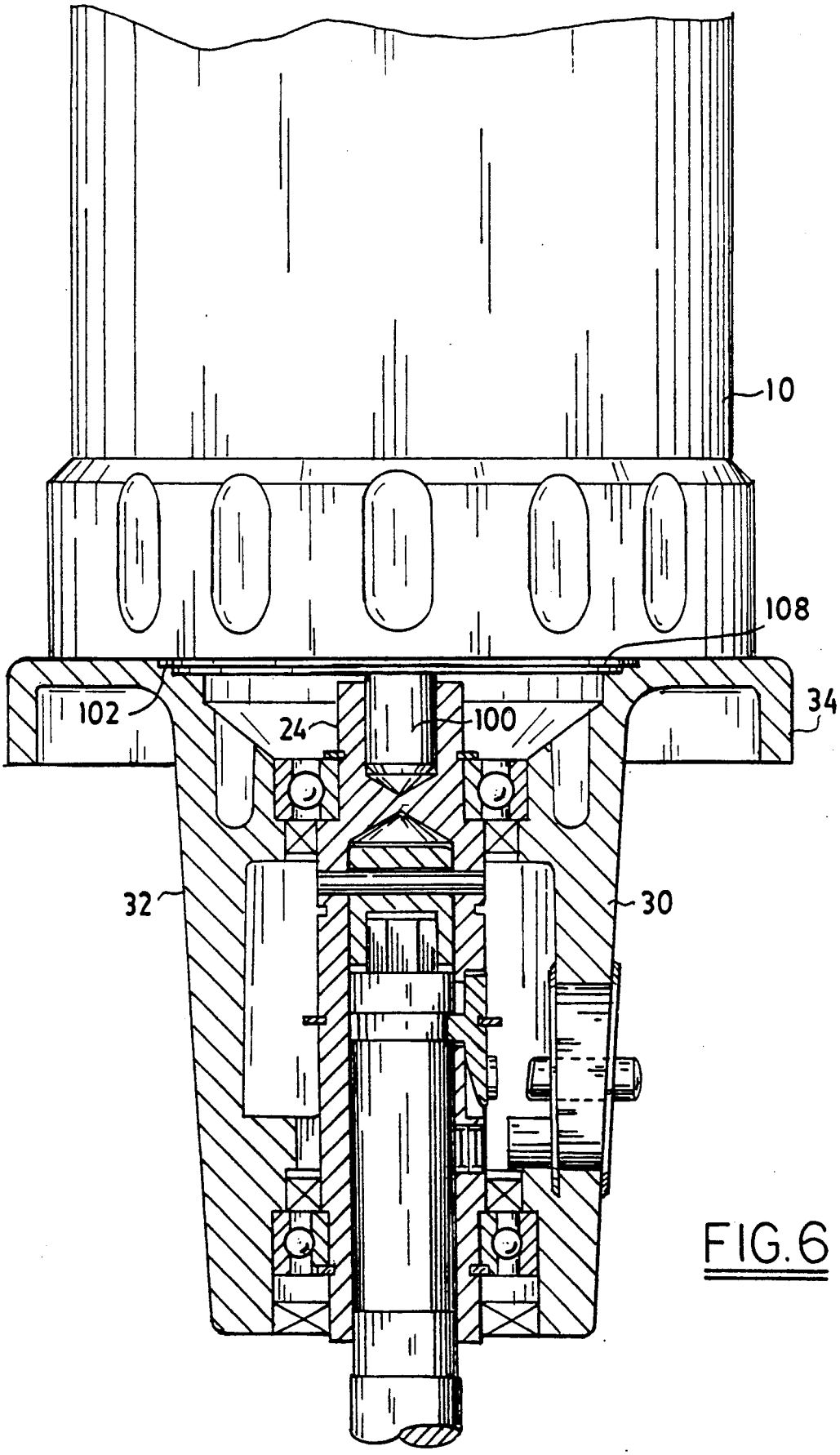
Figure 7:
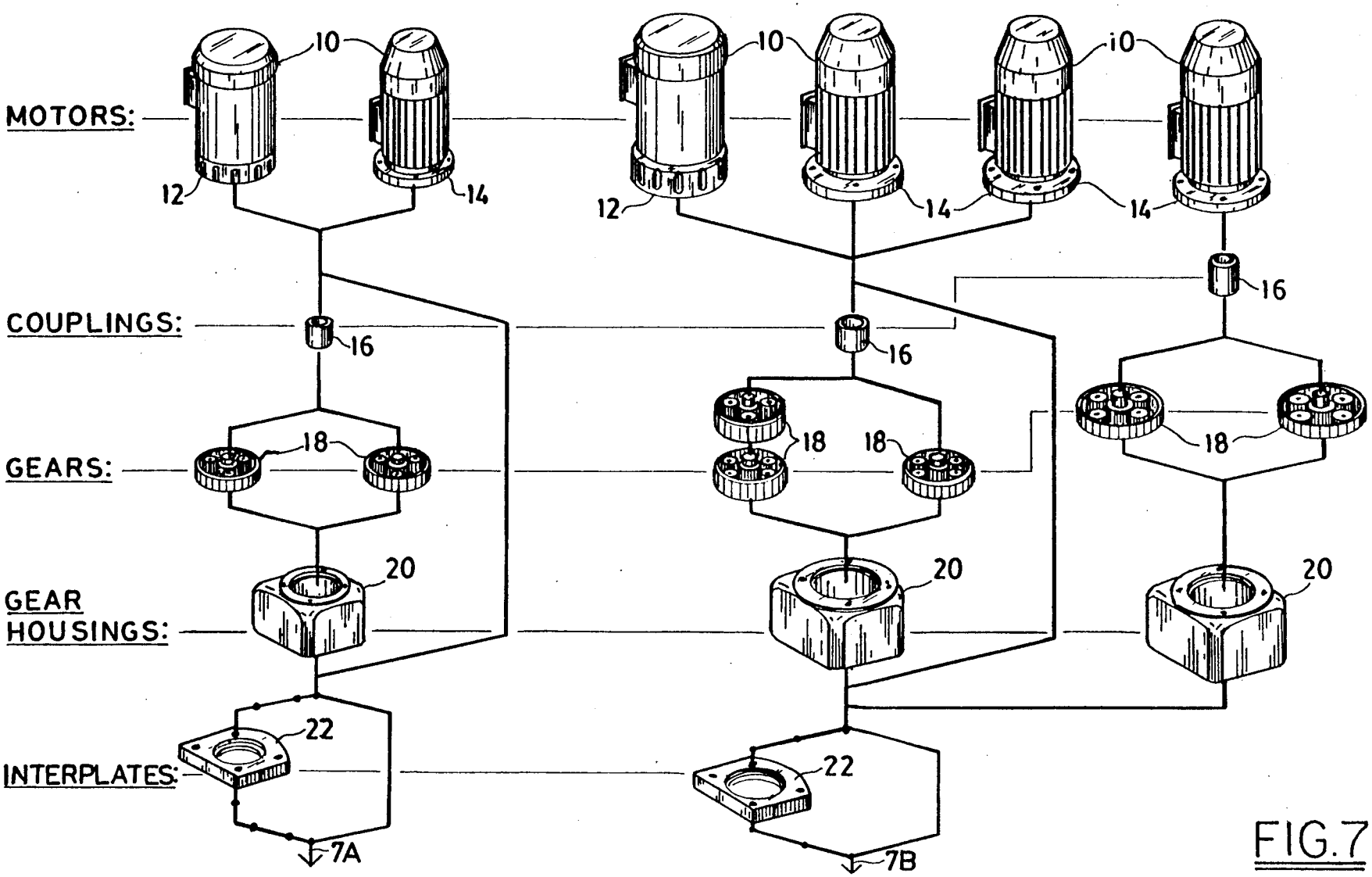
Figure 7:
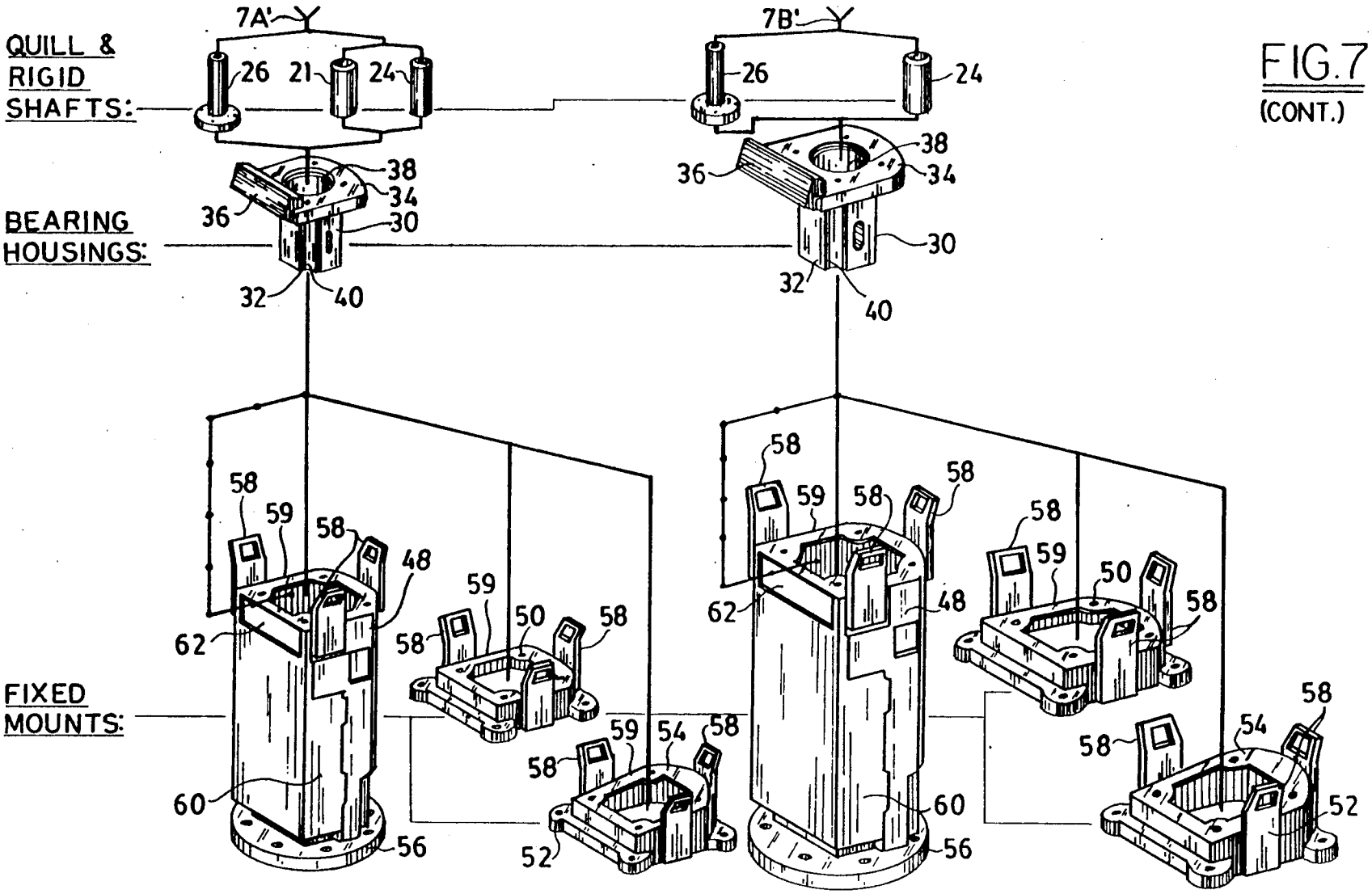
Figure 8:
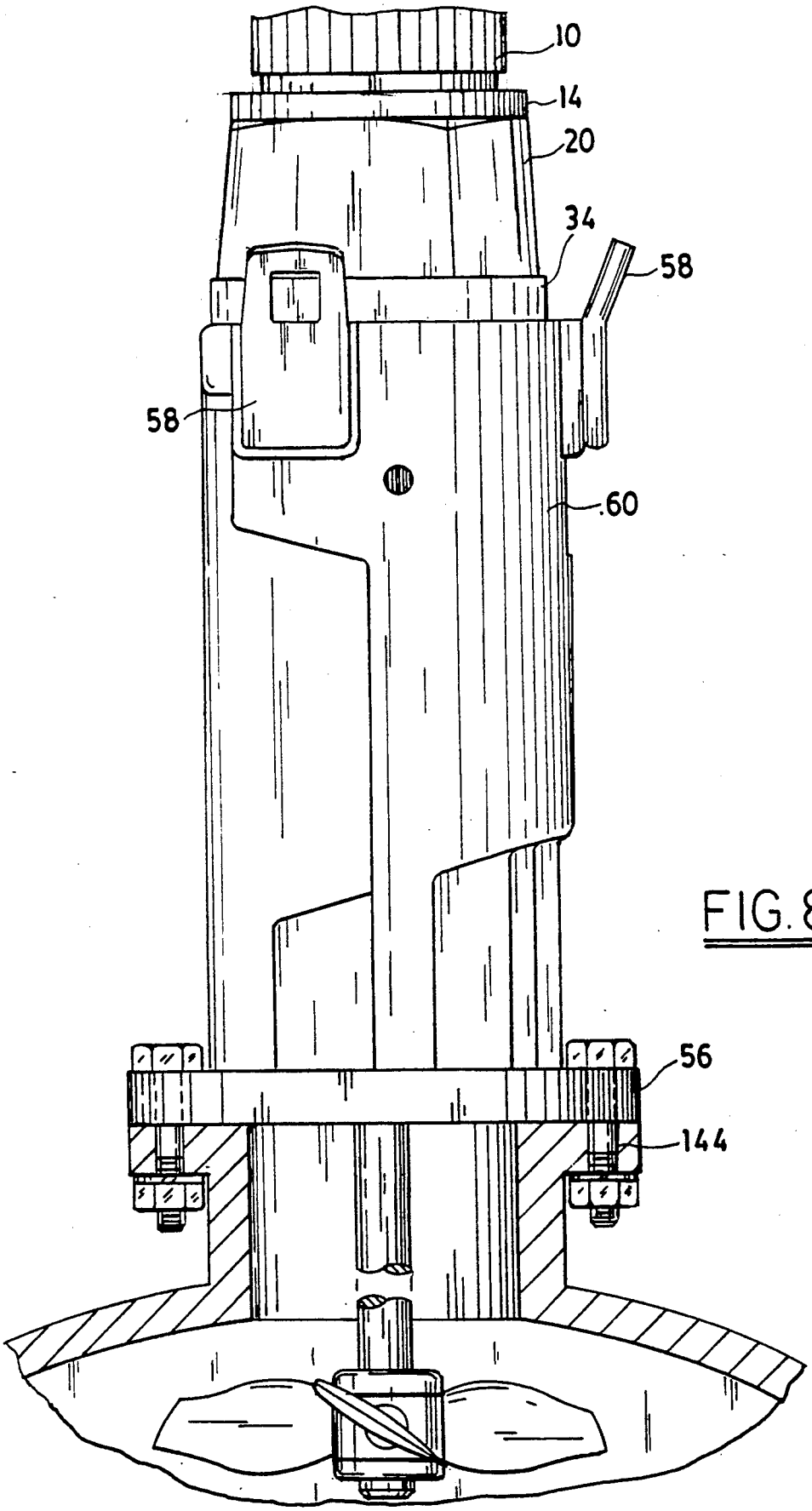
Figure 9:
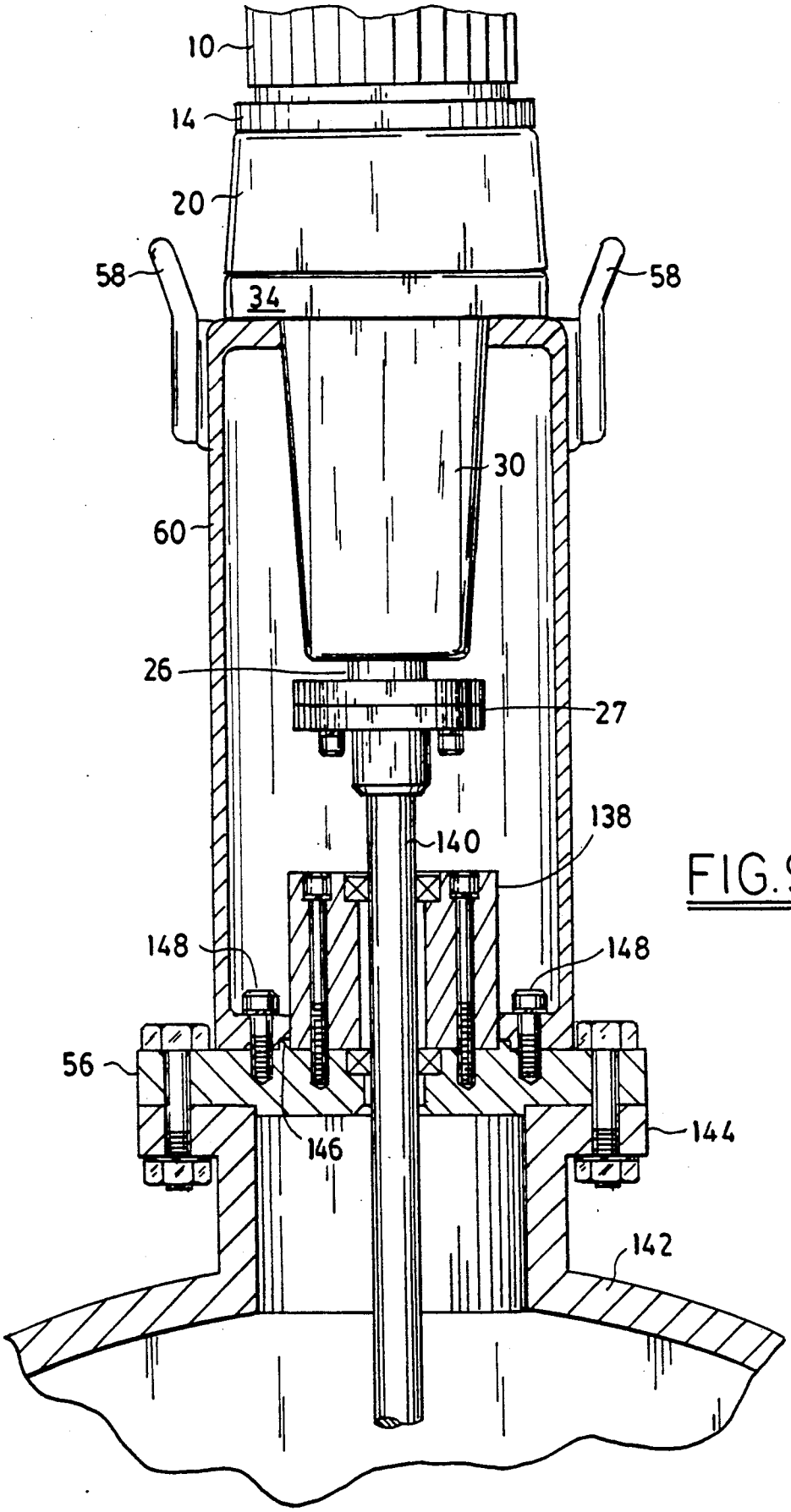
Figure 10:
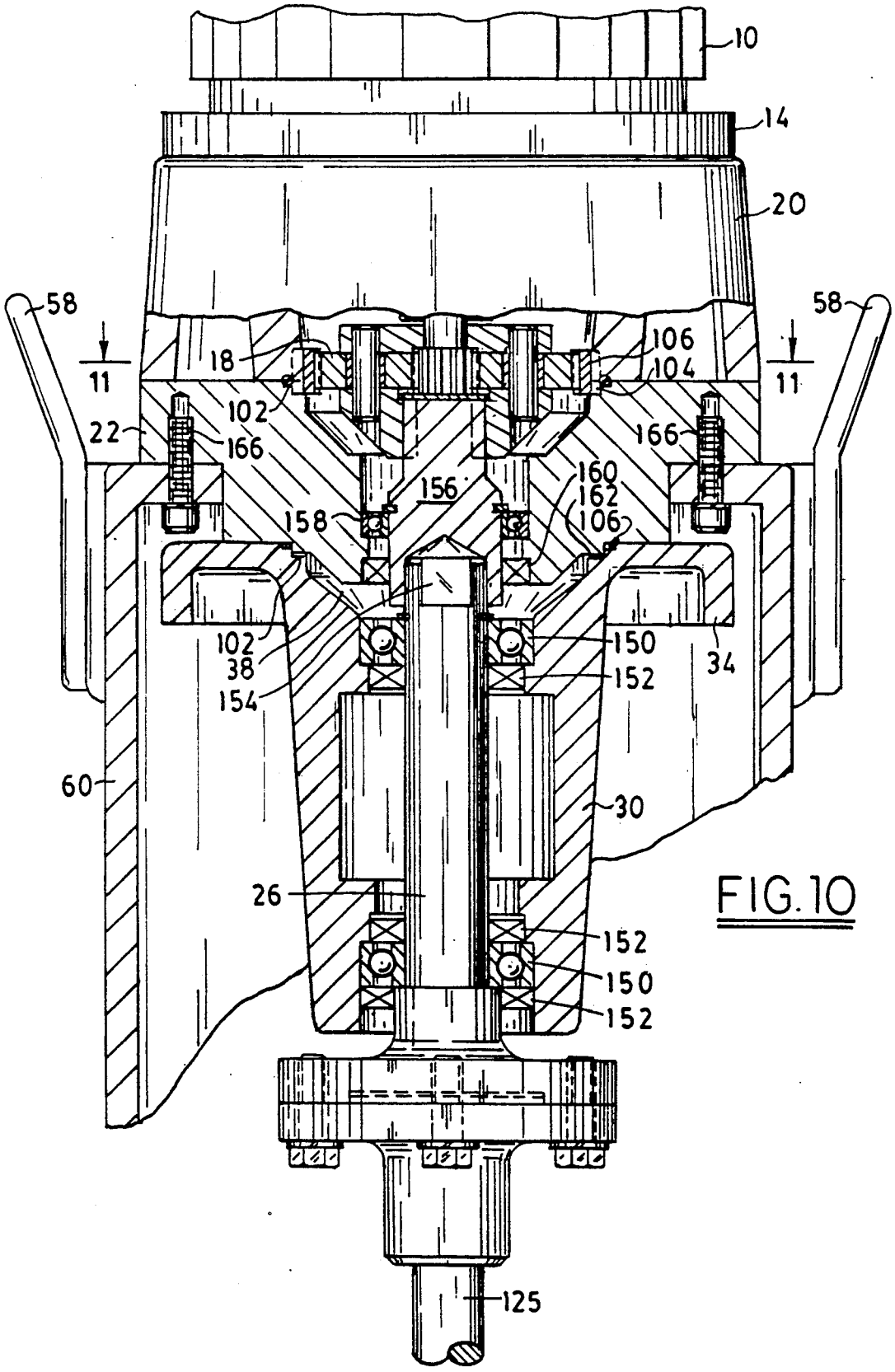
Figure 11:
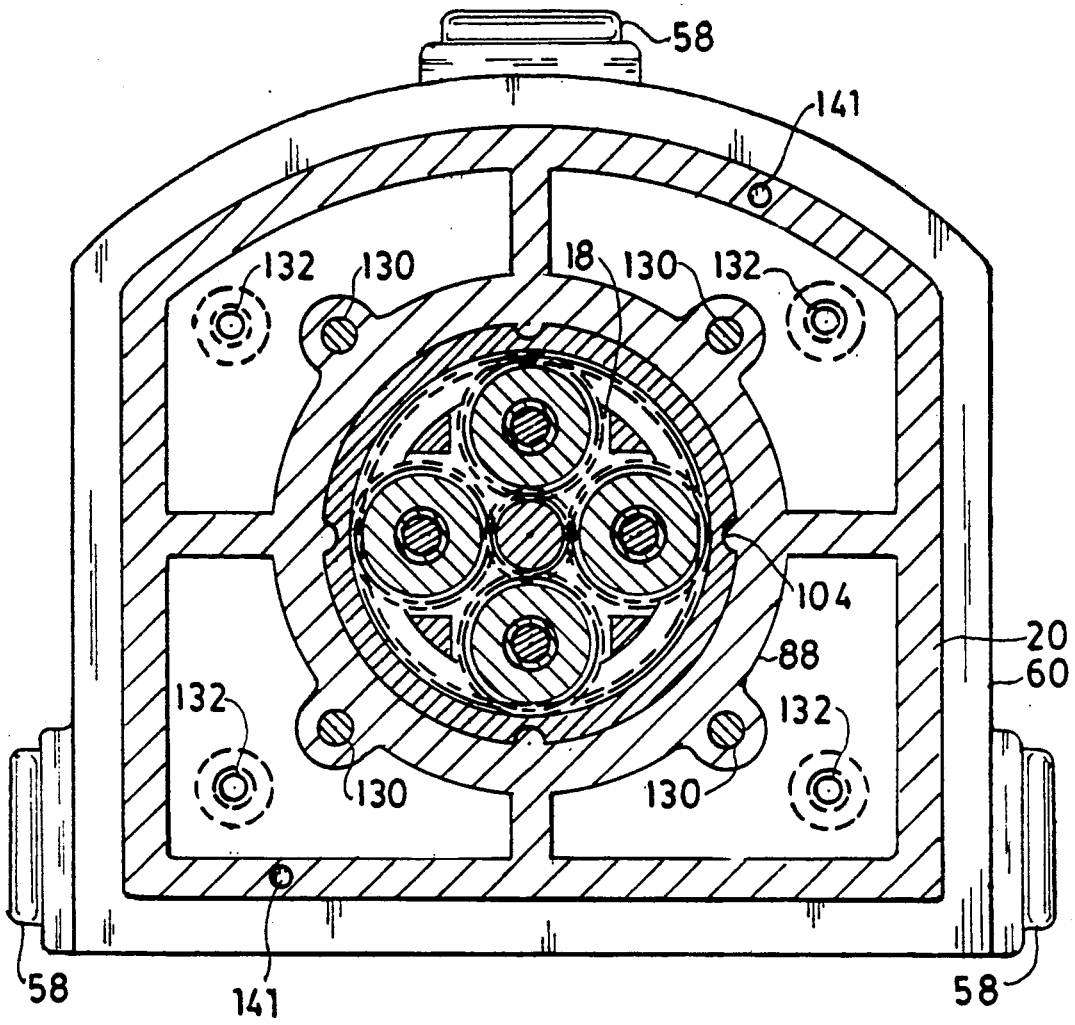

FIG. 3D is a fragmentary sectional view illustrating another interchangeable connection means in accordance with the invention;

FIG. 4 is a sectional view taken along the line 4—4 in FIG. 3;

FIG. 5 is a side view similar to FIG. 2 showing a mixing system assembled from the components in FIG. 1 without the transmission so as to provide a direct drive from the motor shaft to the impeller shaft;

FIG. 6 is a sectional view of the drive subassembly of the mixing system shown in FIG. 5;

FIG. 7 is an exploded view similar to FIG. 1 showing other components and parts including various types of fixed mounts which may be used in providing a modular mixer system in accordance with the invention, it being noted that many of the parts shown in FIG. 1 are similar to those shown in FIG. 7;

FIG. 8 is a side view of a mixer system assembled from the components shown in FIG. 7 mounted on the nozzle of a closed tank;

FIG. 9 is a sectional view illustrating in greater detail the sealing component which is used internally of the pedestal of the mixer system shown in FIG. 8;

FIG. 10 is a sectional view illustrating the drive subassembly of a mixer system having a pedestal mount and which is constructed of modules and components shown in FIG. 7;

FIG. 11 is a sectional view along the line 11—11 in FIG. 10.

Referring to FIGS. 1 and 7, there is shown various motors of the American standard and DIN type of various sizes. All of these motors are indicated by reference numeral 10. The housing of the American standard type motors have endbells 12 which have part of the rabbett which enables the aligned interchangeable assembly of the motors and the other components of the modular mixer system. The other types of motors 10 (the DIN type) have flanges 14 which enables such connection. Various mixer systems are configured by following the solid lines between the components and modules. The gear transmissions involve the use of couplings to provide a flexible connection from the upper shaft of the selected drive motor to the gear set (planetary gears) 18. The couplings 16 and gears which are selected are assembled in a gear housing 20. The planetary gears include and sun and ring gears. The planet gears are rotatable on a carrier and mesh with the sun gear and the ring gear. The gear reduction is determined by the ratios of the sun, carrier and ring gears. In some transmissions the gear sets contain three planetary gears and in others, four, depending upon the stresses allowed on the gears. When still further gear reductions are required, a second planetary gear is connected in tandem (sun gear to carrier) and both gears are placed in their gear housing 20.

In FIG. 7 interplate modules 22 are shown. These carry seals and also have rabbetts for interchangeable attachment to the lower ends of the gear housings. The upper ends of the gear housings are rabbetted for connection to the endbells 12 or flanges 14 of the motors 10. In the event that gear transmissions are not used, the motor drive shaft is directly coupled to a quill shaft 24 or to rigid shafts 26. The quill shafts are generally tubular and have connections at their upper ends to the motor shaft or to the carrier of the planetary gears set, if a gear transmission is used. The quills may be of various different internal diameters so as to fit an impeller shaft of the desired diameter. Since the quills 24 and rigid shaft sections 26 are interchangeable, it is easy to replace impeller shafts, with or without their impellers.

In FIGS. 1 and 7, there are shown the bearing system which provides the commonality which enables modular design. This system is a support structure which supports the shaft. It also supports the other elements of the transmission (gears and gear boxes and interplates). The structure provides for the connection of mounting means. This support structure is indicated as the bearing housing 30 of the mixer system. The bearing housing has a body or shank 32 with a generally D-shaped flange 34 on the upper end thereof.

An enclosure 36 extends along the straight edge and opposite to the curved edge of the flange. This enclosure 36 lips over the flange and may be connected thereto by screws. The enclosure 36 may contain electronic components and displays (alpha numeric LCD), which cooperate with sensors, for displaying the shaft speed. Alternatively, the part 36 provides an area for a name plate, mixer instructions or other indicia.

The quill and the bearings are disposed in and extend through the lower end of a hole 38 in the bearing housing 30. The bearing housing and its quill 24 or rigid stub shaft 26, the motor 10 and the gear housing, with its gears and coupling if selected, and the interplate, if selected, form a unitary drive unit subassembly of the mixer system. These components of the mixer system are all assembled by bolts which extend from the motor (or if an interplate 22 is used also upwardly through the interplate) into the flange 34 of the bearing housing. Corners 40 of the shank of the housing are rounded concavely to provide passage for the attachment bolts.

In the event portable mixer systems are desired, yokes 42 are used. These yokes have handles 44 by which they can be carried alone or with grips provided by a slot 46 along the forward edge of the yoke. The yokes have openings through which the shanks 32 of the bearing housings extend. The yokes are attached by bolts into the bearing house flange 34. These attachment bolts are different from the bolts which attach and assemble the components of the drive unit. Thus the drive unit may be used with a yoke or with a fixed mount either of the pedestal type 48 or mounting plate or riser type 50 and 52. The mounting plates may be flat or their upper surfaces 54 at an angle to the bottom surface as is the case for the angled mounting plates 52. Here again, the fixed mounts are mounted to the flange of the bearing housing 30 except in one instance (FIG. 10) where the connection is by bolts into the interplate 22. The pedestals 48 are often used in closed tanks and have bottom flanges 56 for connection to the nozzle of the closed tank. The mounting plates are used primarily for open tanks and are mounted on beams over such tanks. All fixed mounts have ears 58 for receiving slings of hoists to move the mixer system about an industrial site. The fixed mounts have doors or cover plates 60 to provide access to seals as well as to the rigid shaft 26, when shaft changing is required. An opening 62 which may have a protective plate provides for visibility of the indicia and displays on the enclosure 36.

As shown in FIG. 1 the yoke has a bushing 64 on which a pivot 66 is connected via a tapered shaft through which a bolt (not shown) extends. The pivot 66 is rotatable on a cylindrical post 68 on the top of a clamp 70. A lever actuated set screw may be used to lock the pivot 66 on the clamp 70. This sets the position of the mixer about a generally vertical axis. The bolt which extends through the bushing 64 may be used to lock the yoke and the rest of the mixer system at a selected angular position about a generally horizontal axis. Such an angular position is shown in FIG. 2 where the impeller shaft 72 of a mixer system embodying the invention which is mounted on the wall 74 of a tank 76. The angular position of the impeller 78 can therefore be changed independently about two axes, in accordance with the mixing process desired, in order to create the appropriate flow regime in the tank. As shown in FIG.

2, the yoke mounting 42 has a different pivot which receives an extended bushing having two plates which sandwich the upper end of the pivot. These plates 80 are tightened by a leaver operated bolt to set the angular position of the impeller shaft 72. The mixer shown in FIG. 2 has a gear drive within the gear housing 20 and is also characterized by an indicator 82 which is part of a chuck mechanism for rapidly and safely interchanging impeller shafts. This chuck mechanism and indicator is shown in FIG. 3 and it is also the subject matter of U.S. Pat. No. 5,049,013, issued Sept. 17, 1991 to David J. Engels, Daniel J. Bentley, Gary A. Quinter and Ronald N. Salzman entitled Mixer Apparatus. .

Referring to FIG. 3, the gear housing 20 and the bearing housing 30 are shown in concentric alignment with respect to the axis of the shaft. The motor 10 is also concentrically aligned with the shaft. The gear housing 20 and bearing housing are preferably made of fiber reinforced, compression molded plastic material. The bodies of these parts are formed with annular and axial voids 86 since the molding of such parts makes it desirable for them to have essentially constant cross sections.

As shown in FIG. 4, the gear housing 20 has a central ring 88. Four holes 130 (90° apart) are for motor bolting. This ring 88 receives the ring gear 92 of the planetary gear set 18 which also has the carrier 94, its planetary gears 96 and the sun gear 98. The ring gear 92 is restrained by four holes 104. The sun gear 98 is connected through the coupling 16, which enables the torque from the motor shaft 100 to be distributed among the gears of the planetary gear set 18 thereby equalizing the load on the planet gears. With the ring gear restrained, the carrier 94 rotates. The carrier fits over the bearing housing 30, quill shaft 24 or rigid shaft part 26. The planetary gear sets have different ratios to provide the speeds appropriate to the mixing application to further reduce the shaft speed and increase torque. Preferably, the first set uses three planetary gears and the second set uses four planetary gears. It will be appreciated that the design of the planetary gear and its location in the housing is similar for a four planet gear set. A double reduction using two sets of planetary gears may be employed, one above the other, in the gear housing 20. See FIG. 7 (center grouping).

The concentric coaxial relationship of the members of the drive unit (motor 10, gear transmission 20 and bearing housing 30) is provided by rabbett connections between the respective components. These connections are provided by a female annular stepped groove 102 around the opening 38 in the bearing housing. This groove receives a rim which extends downwardly from the gear housing 20 and is defined by the lobes 104 (four hemicylindrical projections or tangs). These lobes are 90° apart and extend radially into the ring gear 92 to restrain it against any turning movement as discussed generally above. The lobes 104 are also shown in FIGS. 3A, B and C. The length of these lobes is shorter than (approximately equal to) the depth of the lower step 102*a* of the groove 102. The upper step of the slot 102 is adapted to receive a O-ring seal 106 to prevent escape of any grease which lubricates the planetary gears 18.

A similar rabbett connection is made between the endbell of the motor 10 and the upper end of the gear housing 20. The top of the gear housing 20 has an annular groove 106, but with only one step. An annular pad 108 having a step about its outer edge rabbetts with the groove 106 to concentrically dispose and align the motor shaft 100 with the impeller shaft, also with the planetary gear set axis.

It is desirable that the modular mixer system be provided in two sizes; the larger size using the larger gear drive. Such a larger gear drive is shown at 20 in FIG. 3D. The upper support surface of the flange 34 of the bearing housing 30, which is not shown complete with the quill and bearings to simplify the illustration, is provided with a rabbett in the form of an annular pad 110. The outer periphery of the motor housing defines a ring 112 which rabbetts with the pad 110. The height of the ring 112 assures that the upper support surface of the flange 34 contacts and has the lower part of the gear housing resting there against. A groove may be provided in the area where the pad 110 contacts the motor housing base and an O-ring seal fitted into that groove to seal the gear drive against leakage of grease. The upper end of the gear housing also has a pad 114 which receives a rabbett connection similar to that provided by the ring 112 at the base of the gear housing, with the drive motor which is selected for use with the larger size modular mixer system.

Returing to FIG. 3, it will be seen that the quill shaft is mounted in bearings 116 which support the quill 24 by means of snap rings and shoulders. The outer periphery of the upper end of the quill is keyed to the carrier 94 of the planetary gears 18. An internal socket 120 receives a hex head 122 at the upper end of the shaft 22. The chuck mechanism includes a clip 124 pivotly mounted in the quill. An indicator on the clip is visible through a button 126. When aligned with the button 126 a set screw may inserted through a tube 128 and tightened to lock the shaft 22 to the quill 24. To release the shaft, the set screw is simply loosened and the button 126 depressed to contact and pivot the clip 124. The button 126 is mounted in a yieldable elastimeric door so as to enable the button 126 to be depressed when required to release the shaft 22.

Attachment means, preferably bolts shown at 130 in FIG. 4 extend through the flange of the bearing housing 30, through the gear housing and into threaded holes or suitable nuts on the upper side of the flange 14 (see FIG. 1) of some European (DIN) style motors. The drive unit is then assembled as a unitary structure and is ready to be mounted on a portable or fixed mount. In all cases except where an interplate 22 is used (see FIG. 10) the attachment of the mount is to the underside of the flange 34 of the bearing housing 30. Since the bearing housing is made of plastic, threaded inserts 132 in the flange are provided for receiving attachment bolts which extend through the yoke 42 of the portable mounting unit or the upper ends (59 FIG. 7) of the fixed mounts.

Referring next to FIGS. 5 and 6, there is shown a mixer system without a transmission. In other words, the gear drive provided by the gear housing and the planetary gear set(s) is not used in this mixer system. However, modularity is maintained by the rabbett connection between the depending pad 108 at the bottom of the endbell of the motor 10 and the annular stepped groove 102 in the support surface of the flange 34 of the bearing housing 30. The motor shaft 100 then extends directly into the quill 24. A set screw or key is provided for connecting the motor shaft to the upper end of the quill 24.

Referring to FIGS. 8 and 9, there is shown a modular mixer system having a fixed mount pedestal 60 with a flange 56 at the lower end thereof. This mixer system has a motor of the European style with a flange 14 which is assembled with a gear housing 20 to the bearing housing 30 in the manner described above. Then the pedestal 60 is connected to the underside of the flange 34. Alignment is maintained by pins in the top of the pedestal which extend into holes 14 in the flange 34. The location of these holes is indicated in FIG. 11. These locating holes are not used when an interplate 22 is used. The pedestal is mounted to the interplate 22 as shown in FIG. 10. The coaxial and concentric pedestal 60 and bearing housing 30 are coaxial and concentric with a seal unit 138 having seals through which the shaft 140 of the mixer system passes into a closed tank 142. The connection to the tank is between the flange 56 and a flange 144 on the end of the tank's nozzle. This geometry accomodates a stuffing box. Instead of a seal unit 132, a stuffing box may alternatively be used. The term "seal unit" also comprehends a stuffing box. The seal unit 138 is centered by a ring and groove 146. A centering ring is disposed on the flange 56 which mates with a groove in the bottom of the pedestal 60. The connection of the pedestal to the flange 56 is by bolts 148 which extend through the base of the pedestal.

Referring to FIGS. 10 and 11 there is shown still another mixer system which is especially adapted for use in closed tanks where it is desired to seal the mixer drive unit from the contents of the tank. A feature of the arrangement of FIGS. 10 & 11 is that it facilitates seal changing without requiring disassembly of the motor and gear drive assemblies from the pedestal 60 and tank. The mixer impeller shaft 125 is connected to the flange of the impeller stub shaft 26, which is held by bearings 150 surrounded by seals 152 in the bearing housing. The upper end of the shaft 26 has a double D connection 154 to a female double D connection in the lower end of an intershaft 156 which is rotatable in bearings 158 and protected by a seal 160. The intershaft is connected via the bearing to the interplate 22.

The interplate 22 is disposed in concentric alignment by an annular step 162 which rabbets with the groove 102 in the support surface of the flange 34 of the bearing housing 30. There are locating pins in the interplate which enter locating holes in the top of the pedestal.

A seal 106 may be provided around the bearing housing opening 38. The rabbet connection at the upper end of the interplate 22 includes the stepped groove 102 and the rim provided by the projections 104 as described in connection with FIGS. 3, 3A, B and C.

In order to connect the pedestal 60 to the mixer drive unit four screws 166 are used. These screws may be used in lieu of the threaded inserts 132 when an interplate unit is added for sealing purposes in the mixer system. The position of the motor drive unit with respect to the pedestal and any seal unit therein is maintained by the locating pins in the interplate and the locating holes in the pedestal.

To replace seals in the mixer system (for example, a seal unit such as the unit 138 of FIG. 9), it becomes necessary only to follow the following procedure.

First, the seal unit 138 is disconnected from the mounting flange 56. A clamp (a collar) is attached to the shaft 140 below the seal unit. The clalmp is wider than the opening in the flange 56 and holds up the shaft, preventing it from falling into the tank 142. The coupling 27 between the shaft 140 and the stub shaft 26 is then disconnected. The bolts in the flange 34 holding the bearing housing to the interplate 22 are removed and the bearing housing is lowered. The stub shaft 26 and housing 30 are removed from the pedestal through the doorway therein. The seal unit can then be removed and replaced (changed). Thus, a seal change is effected without removal of the gear drive and motor (i.e., all assemblies above the pedestal and motor wiring remain in place).

From the foregoing description, it will be apparent that there has been provided an improved mixing system which is constructed out of modular components. Several embodiments and modules of the sytem have been described which use the modular design concept of the invention. Additional modules and parts will undoubtedly be suggested by those who become familiar with the invention. The invention also provides means for facilitating seal changing (replacement) without total disassembly. Variations in the modular system and seal changing arrangement, within the scope of the inventions will undoubtedly suggest themselves to those skilled in the art. Accordingly, the foregoing description should be taken as illustrative and not in a limiting sense.

We claim:

1. A mixer system for driving at least one impeller on an impeller shaft with a motor, said system being assembled from a plurality of modular components which are selected in accordance with the motor drive power, power transmission and mounting characteristics which characterize the mixer system, said mixer system comprising a first housing having means for rotatably supporting said impeller shaft extending from a lower end of said first housing, said first housing having an upper end, said upper end having first means for interchangeably assembling those of said modular components providing drive power to said impeller shaft, said drive power components being selectable from different motors which are mounted directly upon said upper end for direct drive of said mixer shaft and from different transmissions having lower and upper ends, which are mounted on said upper end of said first housing and have second means for interchangeably assembling said selected one of said different motors at the upper end of said transmissions, and means for assembling a selected one of said modular components which provides a mounting for said mixing system to said first housing.

2. The mixer system according to claim 1 wherein said selected one of said motors has a shaft, said first and second means for interchangeably assembling being provided by means which maintain concentric relationship of said impeller shaft, said motor shaft and one of said different transmissions, when selected.

3. The system according to claim 2 wherein said means which maintain said concentric relationship also maintain said impeller shaft, motor shaft and transmission in coaxial relationship.

4. The mixer system according to claim 1 wherein said first housing is a bearing housing having an opening therethrough and extending between the upper and lower ends thereof and containing means including bearings for rotatably supporting said impeller shaft in said opening.

5. The mixer system according to claim 4 wherein said bearing housing has a flange extending radially from said opening at the upper end thereof and providing upper and lower support surfaces, said first means for interchangeably assembling being disposed in part in said upper support surface.

6. The mixer system according to claim 5 wherein said first interchangeably assembling means comprises rabbet connections disposed in said upper support surface and the selected ones of said different motors and transmissions, and said second interchangeably assembling means comprises rabbet connections in said upper end of said transmissions when selected and the selected one of said motors.

7. The system according to claim 6 wherein said rabbet connections comprise interfitting annular grooves and rims which are concentric with said impeller shaft, said grooves and rims being in different ones of said upper support surface of said flange of said bearing housing and said lower end of the selected ones of said motors and transmissions in said first interchangeably assembly means and in the upper end of said transmissions and the lower end of said motor in said second interchangeably assembling means.

8. The system according to claim 7 wherein said rabbet connections in said first interchangeable assembling means defines an annular groove around said opening in said bearing housing for receiving a seal.

9. The system according to claim 7 wherein said transmission comprises a gear housing containing a set of gears having coaxial input and output shafts connectable to said shaft of said motor and said impeller shaft, respectively, said gear having upper and lower ends and which provide the upper and lower ends of said transmission, an opening extending through said gear housing in which said gear set is disposed.

10. The system according to claim 9 wherein said lower end of said gear housing has a plurality of downwardly extending projections which define the rim of said rabbet connection between said support surface of said flange of said bearing housing and said lower end of said gear housing, said support surface of said gear housing having an annular groove, said projections being of a height no greater than the depth of said groove so that said lower end of said gear housing bears upon said support surface of said bearing housing flange while being maintained in said concentric relationship with said impeller shaft.

11. The system according to claim 10 wherein said set of gears are planetary gears having a sun gear driven from said shaft of said motor, a planetary gear carrier having a plurality of planet gears driven by said sun gear and disposed in driving relationship with said impeller shaft, and a ring gear having an inner periphery with which said planet gears mesh and an outer periphery, said ring gear being attached to said gear housing along the outer periphery thereof, said projections extending radially inward into said ring gear beyond the outer periphery thereof for locking said ring gear against rotation in said gear housing.

12. The system according to claim 10 wherein said modular components further include interplates having openings therethrough in which intershafts are disposed in sealed relationship with said gear housing and said bearing housing, said intershafts being coupled to said impeller shaft, said interplates having upper and lower surfaces including parts of the rabbet connections to said support surface of the flange of said bearing housing and to the lower end of said gear housing.

13. The system according to claim 5 wherein said mountings are selected from the group consisting of fixed mounts and portable mounts having yokes, said bearing housing being disposed in said yokes, said yokes having clamping means connected thereto for connecting said yoke and said mixer system to a wall associated with a tank in which mixing is carried out and for adjusting the angular position of said impeller shaft, said fixed mounts having upper and lower ends connectable respectively to said flange of said bearing housing and to a support structure selected from the group consisting of a wall of a tank in which mixing is carried out, a nozzle leading to a closed tank and a beam over a tank.

14. The system according to claim 13 wherein said fixed mounts are selected from the group consisting of mounting plates and pedestals, said pedestals having flanges at the lower end thereof which connect to said support structure.

15. The system according to claim 14 wherein said pedestals have mounted internally. thereof on said flange at the lower end thereof means around said impeller shaft for sealing said shaft.

16. The system according to claim 5 wherein said flange is generally "D" shaped, a member for electronic display or indicia being mounted on the straight side of said "D" shape along the edge of said flange of said bearing housing.

17. In a mixer apparatus having a drive unit including a motor means for connecting the motor in driving relationship with an impeller shaft, a bearing housing containing means for rotatably supporting the shaft, a seal unit, and means for mounting the drive unit and the bearing housing on a tank in which mixing operations take place, said mounting means containing said bearing housing and said seal unit, said shaft extending into said mounting means and extending therefrom into the tank, the improvement comprising an interplate mounted to said mounting means and supporting said drive unit thereon and said housing in depending relationship therefrom, an intershaft rotatable in said interplate and rotatably connecting said shaft and said drive unit, said bearing housing being detachable from said interplate for removal from said mounting means to expose said seal unit and enable changing thereof.

18. The improvement according to claim 17 wherein said mounting means is a pedestal having a passage for removal of said housing while said seal unit is being changed.

19. The improvement according to claim 18 wherein said pedestal has a top end connected to said interplate and a bottom end having means for connecting said pedestal to said tank.

20. The improvement according to claim 19 wherein said housing has a flange with a shank depending therefrom, said flange being detachably connected to said interplate.

21. The improvement according to claim 17, wherein said housing is a bearing housing having at least one bearing therein, said means rotatably supporting said shaft being rotatably mounted to said bearing housing by said bearings for interconnecting said intershaft and said impeller shaft.

* * * * *